US005144716A

United States Patent [19]

Watanabe et al.

[11] Patent Number: 5,144,716

[45] Date of Patent: Sep. 8, 1992

[54] ELECTRIC CLEANER, METHOD FOR PRODUCING SAME AND MOUNT BASE AND BUMPER FOR ELECTRIC CLEANER

[75] Inventors: Syuji Watanabe, Ibaraki; Kouiti Sagawa, Hitachi; Gorou Sasai, Hitachi; Hidetoshi Sakurai, Hitachi, all of Japan

[73] Assignee: Hitachi, Ltd., Tokyo, Japan

[21] Appl. No.: 417,560

[22] Filed: Oct. 5, 1989

[30] Foreign Application Priority Data

| | | | |
|---|---|---|---|
| Oct. 7, 1988 | [JP] | Japan | 63-251828 |
| Jan. 25, 1989 | [JP] | Japan | 1-013940 |
| Jan. 25, 1989 | [JP] | Japan | 01-013941 |
| Mar. 13, 1989 | [JP] | Japan | 01-057757 |
| Mar. 13, 1989 | [JP] | Japan | 01-057758 |
| Mar. 17, 1989 | [JP] | Japan | 01-063740 |

[51] Int. Cl.[5] ..... A47L 5/36

[52] U.S. Cl. ..... 15/323; 15/325; 15/327.1; 15/327.2; 15/327.7; 15/339

[58] Field of Search ..... 15/257 A, 323, 327.1, 15/327.2, 327.6, 327.3, 339

[56] References Cited

U.S. PATENT DOCUMENTS

| | | | |
|---|---|---|---|
| 2,751,038 | 6/1956 | Acheson | 15/327.3 X |
| 2,779,432 | 1/1957 | Meyerhoefer | 15/323 X |
| 2,814,065 | 11/1957 | Hurd | 15/327.2 X |
| 2,920,337 | 1/1960 | Smith | 15/323 |
| 3,081,478 | 3/1963 | Smithson | 15/327.2 X |

*Primary Examiner*—Chris K. Moore

*Attorney, Agent, or Firm*—Antonelli, Terry Stout & Kraus

[57] ABSTRACT

An electric cleaner is provided with a moving mechanism for avoiding or escaping an obstacle so as to turn and move a cleaner body when the cleaning body collides with the obstacle. According to the electric cleaner, even if the cleaner body is collided with the obstacle, it is easy to escape or avoid away from the obstacle to ensure a smooth travel of the cleaner body while preventing an overturn of the cleaner.

24 Claims, 9 Drawing Sheets

ELECTRIC CLEANER, METHOD FOR PRODUCING SAME AND MOUNT BASE AND BUMPER FOR ELECTRIC CLEANER

BACKGROUND OF THE INVENTION

The present invention relates to an electric cleaner for cleaning a surface to be cleaned such as a floor while traversing such surface, a method for producing such an electric cleaner, and a mount base and a bumper used for an electric cleaner.

In a conventional electric cleaner, a mount base to which casters are mounted at its lower surface is rotatably mounted on a bottom of a cleaner body is disclosed in JP-Y-43-29421, wherein an outer circumferential edge of the mount base with the casters is very narrow in width and is located below of the cleaner body and inside the outermost periphery of the cleaner body.

With respect to the above-described electric cleaner, when the cleaner body is caught at an obstacle such as a corner of furniture and a leg of a table during cleaning, it would be impossible to escape away from the obstacle. Thus, a traveling characteristic of the cleaner is adversing affected. In addition, if the suction hose is forcibly pulled the cleaner body may be overturned or the furniture may be damaged.

SUMMARY OF THE INVENTION

A first object of the present invention is to provide an electric cleaner having excellent traveling characteristics, which may move on a surface to be cleaned while smoothly escaping or avoiding an obstacle such as furniture.

A second object of the invention is to provide an electric cleaner which may smoothly escape an obstacle such as furniture and may smoothly turn at a small turning radius.

A third object of the invention is to provide an electric cleaner which may escape the obstacle without overturn during travel.

A fourth object of the invention is to provide an electric cleaner which prevents an electric source cord from winding around a cleaner body and may escape the obstacle such as furniture.

A fifth object of the invention is provide an electric cleaner for preventing an electric source cord from being caught between a cleaner body and a mount base, while escaping away from the obstacle such as furniture.

A sixth object of the invention is to provide an electric cleaner whose outer appearance have a round shape and which may escape the object such as furniture.

A seventh object of the invention is to provide an electric cleaner for preventing any entrance of dust into the mount base while escaping away from the obstacle such as furniture.

An eighth object of the invention is to provide an electric cleaner which may smoothly ride over projections on the surface to be cleaned and which may escape away from the obstacle such as furniture.

A ninth object of the invention is to provide an electric cleaner which reduces a noise of an electric blower and which may escape away from the obstacle such as furniture.

A tenth object of the invention is to provide a mount base and a bumper suitable for an electric cleaner that may turn at a short turning radius without any overturn.

An eleventh object of the invention is to provide a method for producing an electric cleaner having a semi-spherical upper portion and is capable of escaping smoothly away from an object such as furniture.

In order to attain the first object, there is provided an electric cleaner comprising a cleaner body to which a suction hose is connected, a running means for allowing the cleaner body to run, and a moving member provided so as to be freely movable relative to the cleaner body and located outside an outer periphery of the cleaner body.

In order to attain the second object of the invention, there is provided an electric cleaner comprising a cleaner body including a dust collecting portion encasing a filter therein and an electric blower, a suction hose mounted on the cleaner body, a mount base for carrying the cleaner body, means for turning the cleaner body on the mount base in a drawing direction in which the suction hose is drawn clockwise or counterclockwise direction of the cleaner body, and means for running and turning the mount base on a surface to be cleaned, so that the cleaner body is moved in a direction along which the cleaner body escapes from an obstacle when the mount base collides against the obstacle on the surface to be cleaned. The mount base is in the form of a cylinder, with a lower portion of the cleaner body being engaged within the cylindrical mount base, and an inner wall portion, engaged with the cleaner body, of the mount base and an outer wall portion, engaged with the mount base, of the cleaner body both substantially in the form of true circles in cross section.

In order to attain the third object of the invention, there is provided an electric cleaner comprising a cleaner body including a dust collecting portion encasing a filter therein and an electric blower, a suction hose mounted on the cleaner body, a mount base for carrying the cleaner body, means for turning the cleaner body on the mount base in a drawing direction in which the suction hose is drawn clockwise or counterclockwise direction of the cleaner body, and means for running and turning the mount base on a surface to be cleaned, so that the cleaner body is moved in a direction in which the cleaner body escapes from an obstacle when the mount base collides against the obstacle on the surface to be cleaned, wherein a plurality of legs extend radially outwardly from the mount base, and the running means is provided on the legs.

In order to attain the fourth object of the invention, there is provided an electric cleaner comprising a cleaner body including a dust collecting portion encasing a filter therein and an electric blower, a suction hose mounted on the cleaner body, a mount base for carrying the cleaner body, means for turning the cleaner body on the mount base in a drawal direction in which the suction hose is drawn clockwise or counterclockwise direction of the cleaner body, means for running and turning the mount base on a surface to be cleaned, so that the cleaner body is moved in a direction in which the cleaner body escapes from an obstacle when the mount base collides against the obstacle on the surface to be cleaned, and means for limiting a turning angle of the cleaner body.

In order to attain the fifth object, there is provided an electric cleaner comprising a cleaner body including a dust collecting portion therein and an electric blower, a mount base for carrying the cleaner body to be turnable, means for turning and running the mount base on a surface to be cleaned, cord reel provided in the cleaner body, around which an electric source cord is wound, and a cord port provided in the cleaner body, through which the electric source cord is withdrawn from the cleaner body, wherein a gap between the cleaner body and the mount base is smaller than a diameter of the electric source cord.

In order to attain the sixth object, there is provided an electric cleaner comprising a cleaner body including a dust collecting portion encasing a filter therein and an electric blower, a suction hose mounted on the cleaner body, a mount base for carrying the cleaner body, means for turning the cleaner body on the mount base in a drawing direction in which the suction hose is drawn clockwise or counterclockwise direction of the cleaner body, and means for running and turning the mount base on a surface to be cleaned, so that the cleaner body is moved in a direction in which the cleaner body escapes from an obstacle when the mount base collides against the obstacle on the surface to be cleaned, wherein the cleaner body is composed of a semi-spherical upper case and a cylindrical lower case, and the mount base is a cylindrical mount base in which the lower case is engaged.

In order to attain the seventh object of the invention, there is provided an electric cleaner comprising a cleaner body including a dust collecting portion encasing a filter therein and an electric blower, a suction hose mounted on the cleaner body, a mount base for carrying the cleaner body, means for turning the cleaner body on the mount base in a drawing direction in which the suction hose is drawn clockwise or counterclockwise direction of the cleaner body, and means for running and turning the mount base on a surface to be cleaned, so that the cleaner body is moved in a direction in which the cleaner body escapes from an obstacle when the mount base collides against the obstacle on the surface to be cleaned, wherein the cleaner body is composed of an upper case and a lower case, the mount base is a cylindrical mount base in which the lower case is engaged, and at least an outer circumference of a lower edge of the upper case is flush with or inside an outer periphery of the mount base.

In order to attain the eighth object, there is provided an electric cleaner comprising a cleaner body including a dust collecting portion encasing a filter therein and an electric blower, a suction hose mounted on the cleaner body, a mount base for carrying the cleaner body, means for turning the cleaner body on the mount base in a drawing direction in which the suction hose is drawn clockwise or counterclockwise direction of the cleaner body, and a plurality of casters for running and turning the mount base on a surface to be cleaned, so that the cleaner body is moved in a direction in which the cleaner body escapes from an obstacle when the mount base collides against the obstacle on the surface to be cleaned, wherein a plurality of legs are provided to extend outwardly from the mount base on which the casters are provided, an upper surface of each of the legs is curved, and a mount frame for each of the casters is shaped in a body, and a bowl-shaped mount frame is used to cover a lower surface of each of the legs.

In order to attain the ninth object of the invention, there is provided an electric cleaner comprising a cleaner body including a dust collecting portion encasing a filter therein and an electric blower, a suction hose mounted on the cleaner body, a mount base for carrying the cleaner body, means for turning the cleaner body on the mount base in a drawing direction in which the suction hose is drawn clockwise or counterclockwise direction of the cleaner body, and means for running and turning the mount base on a surface to be cleaned, so that the cleaner body is moved in a direction in which the cleaner body escapes from an obstacle when the mount base collides against the obstacle on the surface to be cleaned, wherein the mount base is in the form of a cylindrical mount base, a lower portion of the cleaner body is engaged with the cylindrical mount base, and an exhaust flow of the electric blower flowing from an interior of the cleaner body toward the mount base is discharged to the outside through a space between the mount base and the cleaner body.

In order to attain the tenth object there is provided a mount base comprising a cylindrical portion, a plurality of legs extending from a side wall of the cylindrical portion, an upper surface of each of the legs is curved, casters provided on the legs, a mount frame of each of the casters is in the form of bowl by which a lower surface of each of the legs is covered, a bumper mounted on the side wall of the mount base, and an elastic cover integrated with the bumper to cover upper surfaces of the legs.

In order to attain the eleventh object, there is provided a method for manufacturing an electric cleaner comprising the steps of holding an upper case substantially horizontally with its opening directed upwardly, mounting an inner case, a cord reel, a sound shielding case and an electric blower within the upper case, mounting a cylindrical lower case on which small wheels are attached in advance onto the upper case, and mounting a mount base on which casters are mounted in advance onto the lower case.

During cleaning, when the suction hose is pulled, the cleaner body is moved by the running means on a surface to be cleaned in the direction in which the hose is drawn. By the running, the mount base collides with the obstacle such as a corner of the furniture and legs of the table. At this time, when the suction hose is further pulled, the mount base is moved while turning and is moved in a direction in which the cleaner body is separated away from the obstacle. Thus, there is no fear that the cleaner body would be kept in a condition that it is caught by the obstacle. Then, the cleaner body and the mount base are run on the surface in a direction where they are pulled by the suction hose by a slight force.

Even if the mount base is held substantially in a fixed condition on a surface to be cleaned, when the suction hose is drawn in a circumferential direction of the cleaner body, because the engagement portion of both the mount base and the cleaner body is substantially truely circular, the cleaner body is smoothly turned on the mount base and the suction hose and the cleaner body are turned on the mount base with a small turning radius. When at least an upper portion of the cleaner body is semi-spherical, the small radius turning of the suction hose is further improved. Also, when the cleaner body is turned about a center axis of the mount base, since a plurality of circular-cross-section members are turned while supporting the bottom of the cleaner body, the cleaner body is smoothly turned without a significant swing thereof.

When the running means, such as casters, are attached to the legs extending outwardly from the mount base, even if the cleaner body is slanted during the running on the surface to be cleaned, the running means serve to support the cleaner body, thereby preventing the cleaner body from turning over. Also, with an electric blower having a large weight and a cord reel disposed within the bottom of the cleaner body, the center of gravity of the cleaner body is close to the surface to be cleaned, thereby stabilizing the running of the cleaner body. Also, when the suction hose is mounted on the cleaner body so that its mounted portion of the suction hose is slanted downwardly, the slant angle of the cleaner body is decreased when the suction hose is drawn, thereby preventing the overturning of the cleaner body. When the legs project radially outwardly from the peripheral wall of the cylindrical mount base, the bottom of the cylindrical mount base may be close to the surface to be cleaned, and then the cleaner body mounted on the cylindrical mount base may be closer to the surface to be cleaned.

The cleaner body is turned on the mount base but the turning angle thereof is limited within a predetermined range by the turning angle limiting means. Thus, there is no fear that the electric source cord would be wound around the cleaner body or the mount base several times. There is no fear that any excessive force is applied to the electric source cord.

Since the gap between the cleaner body and the mount base is smaller than an outer diameter of the electric source cord, when the cord would be wound around the cleaner body, there is no fear that the cord would be caught by the gap. This improves the handling characteristics of the cleaner.

Since the cleaner body is composed of a semi-spherical upper case and a cylindrical lower case, it is easy to fabricate the cleaner body having a round appearance. Further, in case that the cleaner body is formed of upper and lower cases and a lower circumferential edge of the upper case is flush with or outside the outer periphery of the mount base, it is possible to prevent the dusts passing through the outer peripheral surface of the upper case from entering into the mount base.

During the running of the cleaner body, the lower surfaces of the legs extending radially outwardly from the mount base are covered by bowl-shaped mount frames which serve as sleds to readily ride over the projections on the floor.

During the operation of the electric blower, after the exhaust flowing from the electric blower impinges against the mount base from the bottom of the cleaner body and is then discharged from the gap between the cleaner body and the mount base, the noises generated from the electric blower are reduced.

The cleaner body is turnable clockwise and counterclockwise on a wheel base, and it is the suction hose that applys the turning force to the cleaner body from the outside during the cleaning. On the other hand the primary member for determining the position of the center of gravity of the cleaner is the electric blower. The suction hose for applying the external force to the cleaner and the electric blower serving as a member for preventing the overturning of the cleaner are disposed diametrically opposite to each other with respect to the turning center of the cleaner body, thereby preventing an overturning. The cleaner may be turned at a small turning radius even on a shag carpet.

Even if the cleaner body is turned on the mount base, the suction hose connected to the cleaner body is also turned. Accordingly, it is possible to prevent a generation of twists of the suction hose, an overturning of the cleaner body, and a damage of the suction hose.

DETAILED DESCRIPTION OF THE PREFERRED EMBODIMENTS

Figure 1:
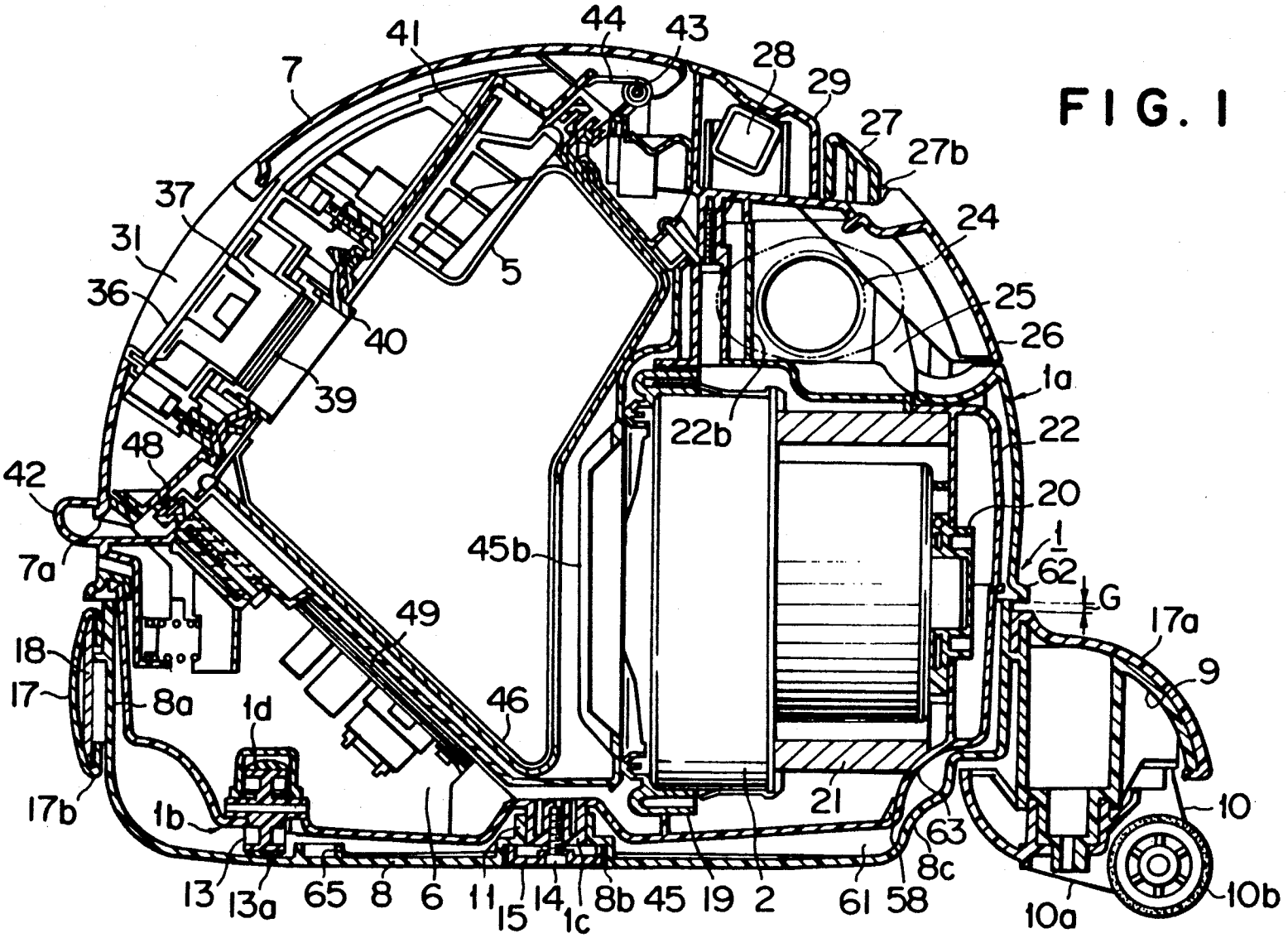
FIG. 1 is a cross sectional view showing of an electric cleaner constructed in accordance with the present invention.
Figure 2:
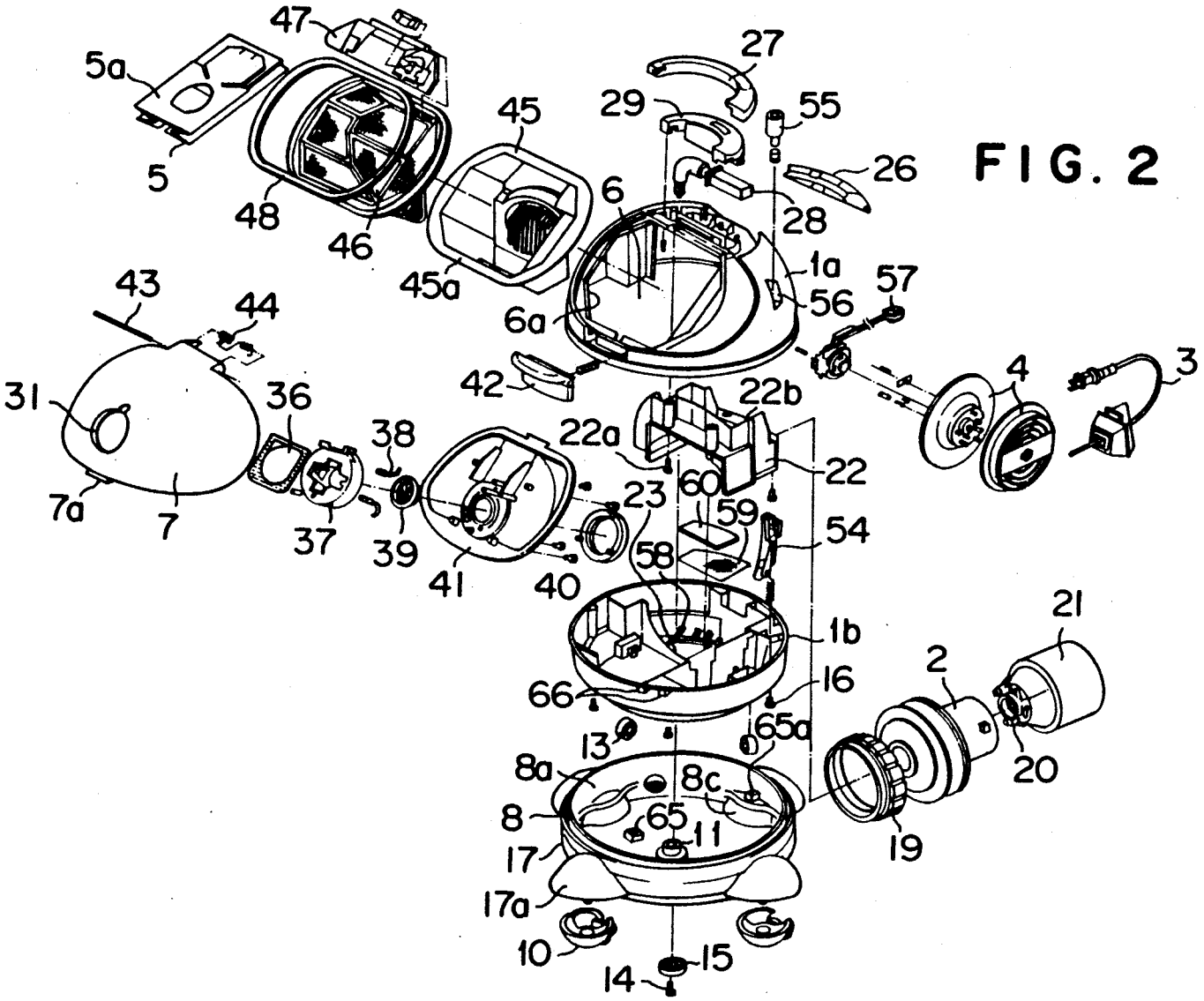
FIG. 2 is an exploded of the cleaner of FIG. 1.
Figure 3:
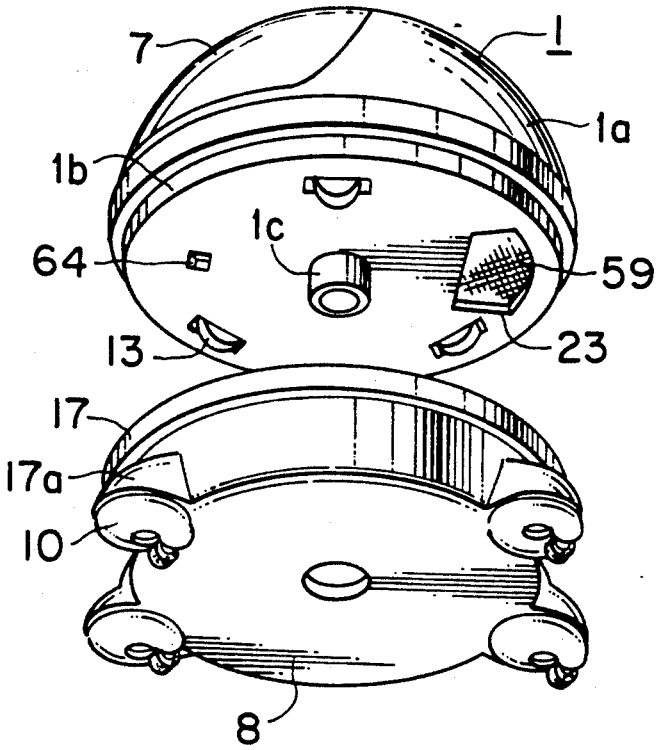
FIG. 3 is a perspective view showing a separated condition between the cleaner body and the mount base.
Figure 4:
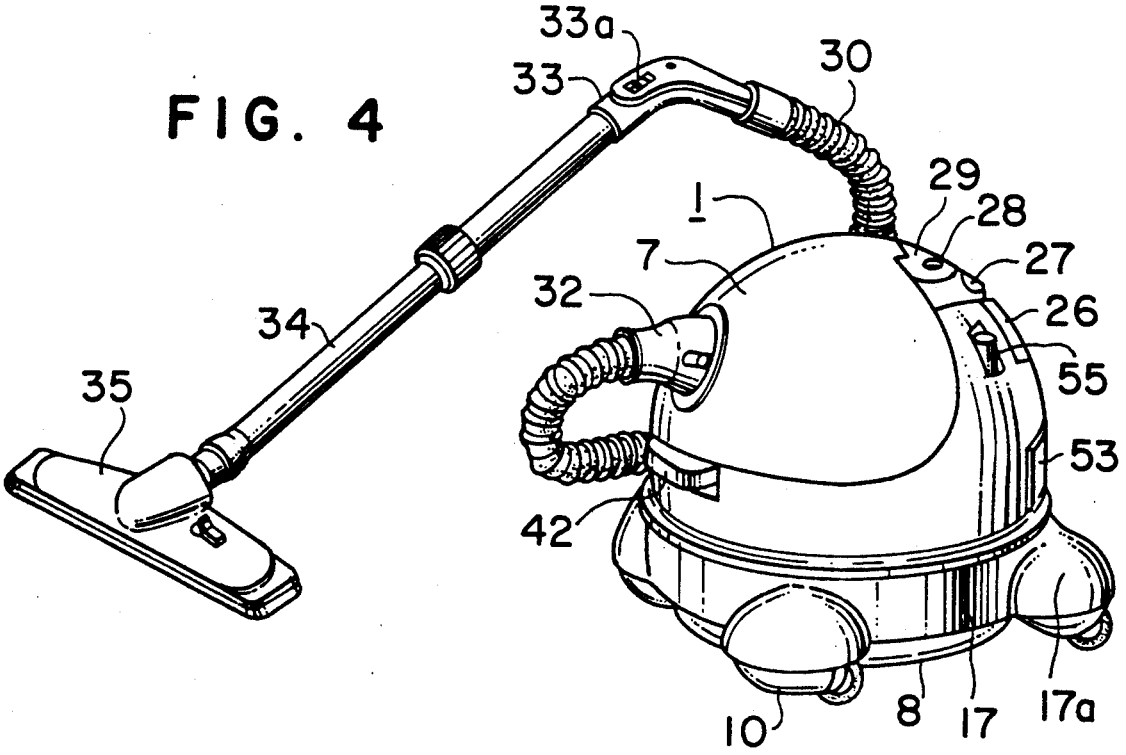
FIG. 4 is a perspective view showing an overall cleaner.

Referring now to the drawings wherein like reference numerals are used throughout the various views to designate like parts and, more particularly, to FIGS. 1 and 2, according to these FIGS., an electric cleaner includes a body 1 which accommodates therein an electric power blower 2 and a cord reel 4 around which an electric cord 3 is wound. A dust collecting portion 6, encasing a disposable paper filter 5 is disposed on an upstream side of the electric blower 2. A cover 7, of synthetic resin is pivotally mounted to open and close an opening **6*a* of the dust collecting portion 6**.

The cleaner body 1 is made of synthetic resin and is composed of a substantially semi-spherical upper case **1*a* having, for example, a radius of curvature of about 150 mm, and a cylindrical lower case 1*b*. The cleaner body 1 is mounted on a cylindrical mount base 8 of synthetic resin. The cleaner body 1 and the mount base 8 are coupled so as to be turnable relative to each other. The mount base 8 has four legs 9 each extending outwardly from a peripheral wall thereof, with the four legs 9 being arranged equiangularly at about 90 degrees. The lower case 1*b* is fitted into a cylindrical portion 8*a* of the mount base 8. Each of the wall portion of the lower case 1*b* and the cylindrical portion 8*a* of the mount base 8 has a cross-section defined substantially by a true circle. Each leg 9 has a caster 10 serving as travel means. The caster 10 is composed of a mount frame 10*a* rotatably mounted on a lower surface of the leg 9 and a wheel 10*b* rotatably mounted on the mount frame 10*a*. The mount frame 10*a* is rotatable about an axis extending in the vertical direction. The wheel 10*b* is rotatable about an axis extending in the horizontal direction. An upper surface of the leg 9 is curved with, for example, a radius of curvature of about 64 mm and is contiguous with the outer wall of the mount base 8 through a smooth curved surface. The mount frame 10*a* is in the form of a bowl sled, with, for example, a radius of curvature of about 45 mm, to cover the lower surface of the leg. The axis of the mount frame 10***a* is located outside of the peripheral wall of the mount base 8.

A hollow shaft 11 is integrally formed with a central portion of the mount base 8. A turning means for the cleaner body 1, i.e., an engaging shaft 1*c* which is engageable with the shaft 11 is integrally formed in a central portion of the bottom of the lower case 1*b*. Between the lower case 1*b* and the mount base 8, there interposed are three rotatable members 13 each having a circular cross section for facilitating the turning of the case 1*b*. Each rotatable member 13 is composed of a wheel of synthetic resin, and is detachably mounted in a recess 1*d* of the bottom of the lower case 1*b*. An elastic member 13*a* for absorbing the noise due to rotation is attached to an outer peripheral surface of the member 13. A lowermost portion of the member 13 is located outside of the lower surface of the engaging shaft 1*c*. The lower case 1*b* of the cleaner body 1 is rotatably mounted on the mount base 8 by a fastening member 14 or a single screw and a retainer cover 15 made of synthetic resin. In a portion of the bottom of the mount base 8 corresponding to the shaft 11, there is formed a recess 8*b* into which the retainer cover 15 is fitted. The retainer cover 15 is fixed to the engaging shaft 1*c* exposed in the recess 8*b* by a screw 14, so that when the lower case 1*b* is turned, the retainer cover 15 is turned within the recess 8*b*. The retainer cover 15 is arranged so that its outer surface is not projected from the bottom surface of the mount base 8.

The upper and the lower cases 1*a* and 1*b* are fixed to each other by a plurality of screws 16. At least a lower edge portion of the outer surface of the peripheral wall of the upper case 1*a* is located outside of the outer surface of the peripheral wall of the lower case 1*b*. A bumper 17 made of rubber surrounds the outer surface of the peripheral wall of the mount base 8. The bumper 17 is mounted by inserting both edge portions 17*b* thereof between a rib 18 having a T-shape in cross section and formed on the mount base 8 and the mount base 8. An air layer having a maximum width of 2 mm is formed between the bumper 17 and the mount base 8. The bumper 17 is made of rubber having a thickness of 3 mm. The width of the bumper mounted on the mount base 8 is about 56 mm. Four elastic, bowl-shaped covers 17*a* covering entire upper surfaces of the legs 9 are integrally formed on the bumper 17. The outer peripheral surface of the bumper 17 mounted on the peripheral wall of the mount base 8 is located radially outside the outer surface of the peripheral wall of the upper case 1*a*.

The electric blower 2 is supported within the cleaner body 1 in a vibration proof manner through vibration absorber rubber members 19 and 20. A cylindrical sound absorber 21 of foamed urethane is provided around the motor of the electric blower 2. A sound shielding case 22 of heat resistant synthetic resin is used to encase therein the electric blower 2 and the sound absorber 21. An exhaust port 23 for enabling a flow of the exhaust air from the electric blower 2 toward the mount base 8 is formed in the bottom of the lower case 1*b*. The sound shielding case 22 is fixed to the wall of the upper case 1*a* by a plurality of screws 22*a*. The sound shielding case 22 also to contacts, at the lower surface thereof, with the lower case 1*b* to form an exhaust duct between the blower 2 and the port 23 when the upper case 1*a* and the lower case 1*b* are coupled to each other. A side wall 22*b* of a chamber 25 for receiving accessories 24 is integrally formed on the upper surface of the sound shielding case 22. The chamber 25 is formed between the side wall 22*b* and the upper case 1*a*. An opening 25*a* in communication with the chamber 25 is formed in the wall of the upper case 1. A cover 26 is pivotally mounted to open and close the opening 25*a*.

A grip 27 of a synthetic resin and an indicator 28 are provided on an upper portion of the upper case 1*a*. The indicator 28 is mounted by an indicator retainer 29, of synthetic resin, in a recess formed in the upper portion of the upper case 1*a*. A bearing portion for the grip 27 and a bearing portion for the cover 7 covering the withdrawal opening 6*a* are formed in the indicator retainer 29. A recess 27 is formed in the upper case 1*a* to receive the grip 27. The grip 27 is rotatably supported between the indicator retainer 29 and the upper case 1*a*. The grip 27 is retracted into the recess 27*b* when it is unnecessary to lift the cleaner body 1, and is adapted to be is pulled up from the recess 27*b* when lifting the cleaner body 1. A grip recess 26*b* contiguous with the recess 27*b*, is formed in the cover 26. The grip recess 27*a* also serves as a grip recess for the grip 27. A projection 27*a* is formed on the upper surface of the grip 27 to facilitate a grasping the grip 27. The upper surface shapes of the indicator 28, the grip 27, the receiving chamber cover 26 and the cover 7 are curved to be in conformity with the semi-spherical shape of the upper case 1*a*, thereby preventing it from being damaged.

Figure 9:
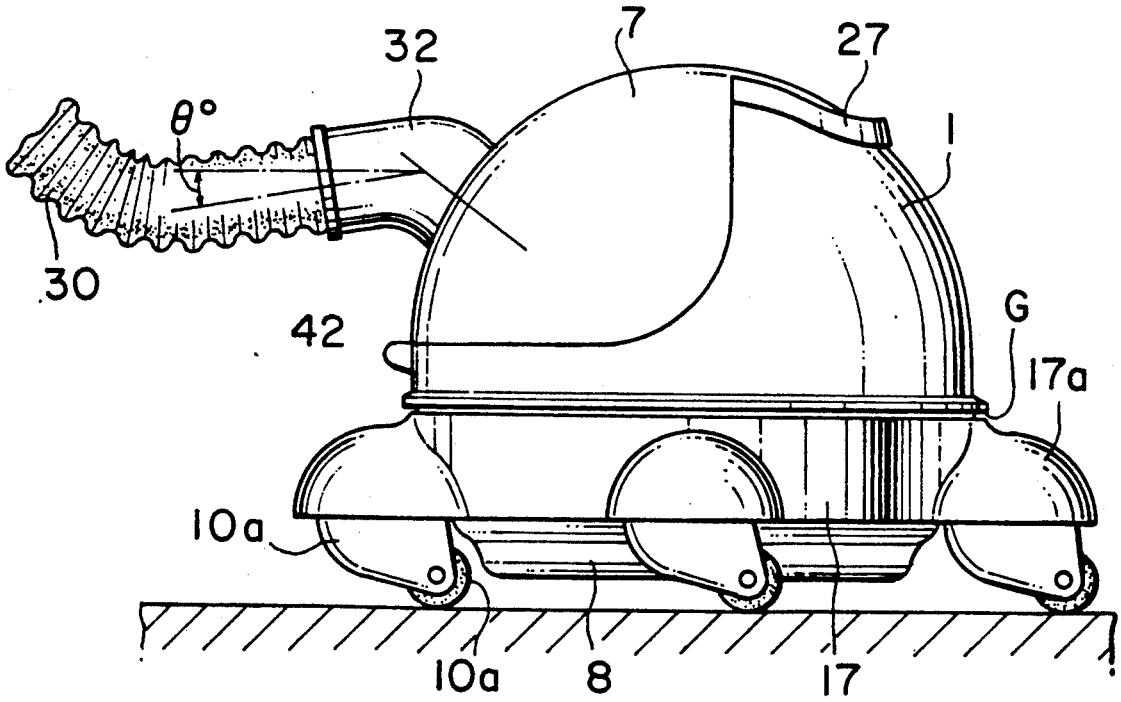
FIG. 9 is a side elevational view showing the cleaner.
Figure 10:
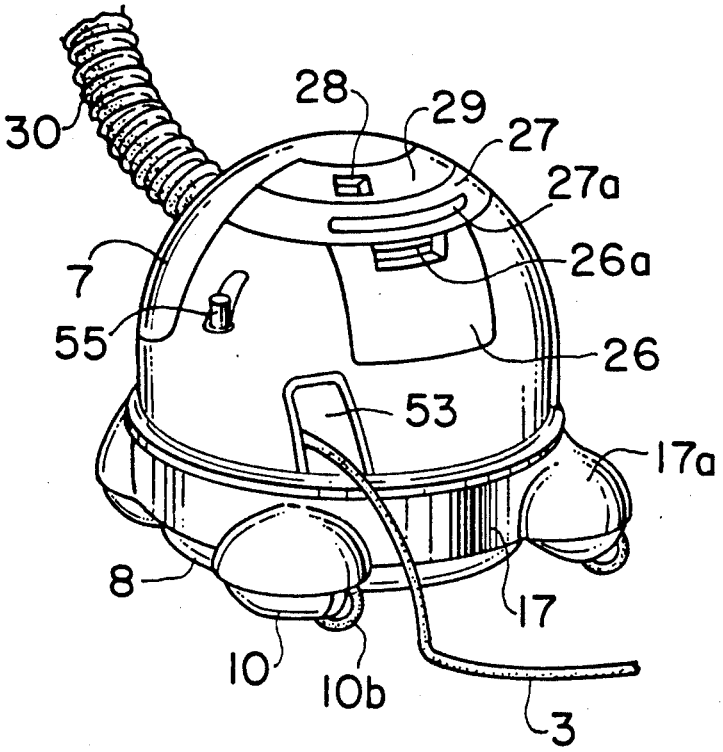
FIG. 10 is a perspective view showing the cleaner when a cover for an accessory chamber is closed.
Figure 11:
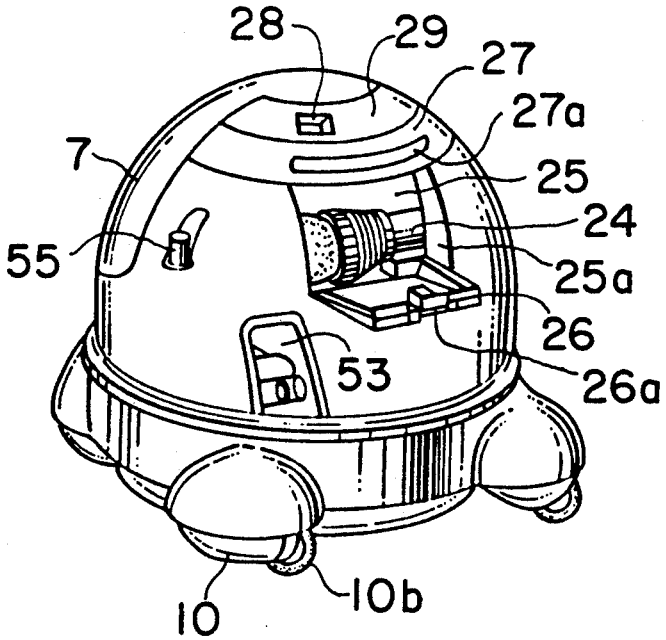
FIG. 11 is a perspective view showing the cleaner when the cover is opened.
Figure 12:
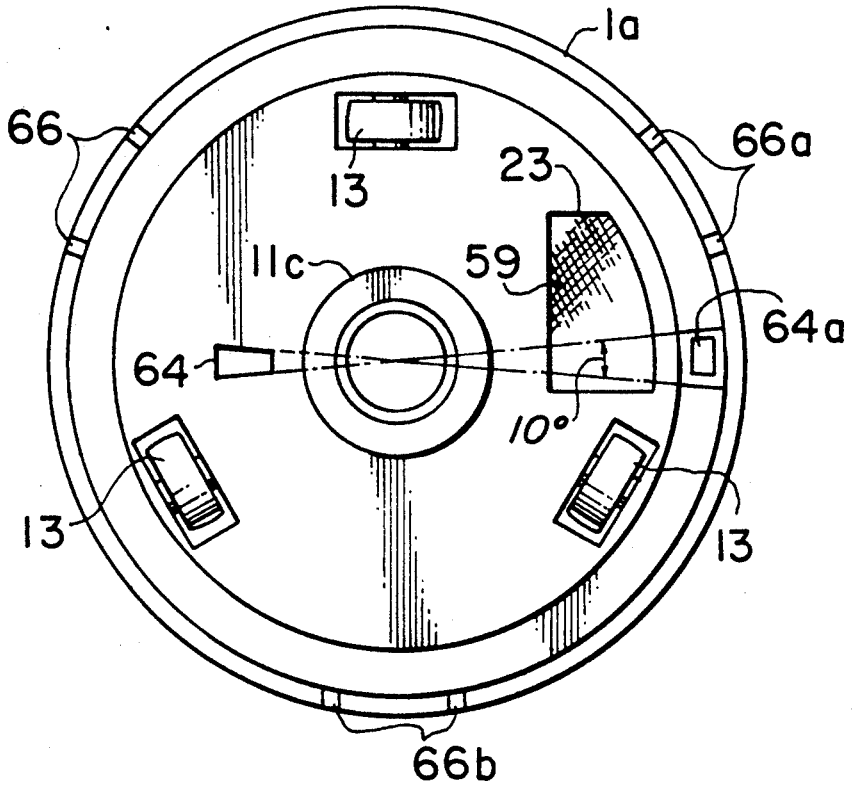
FIG. 12 is an enlarged bottom view showing the cleaner body.
Figure 13:
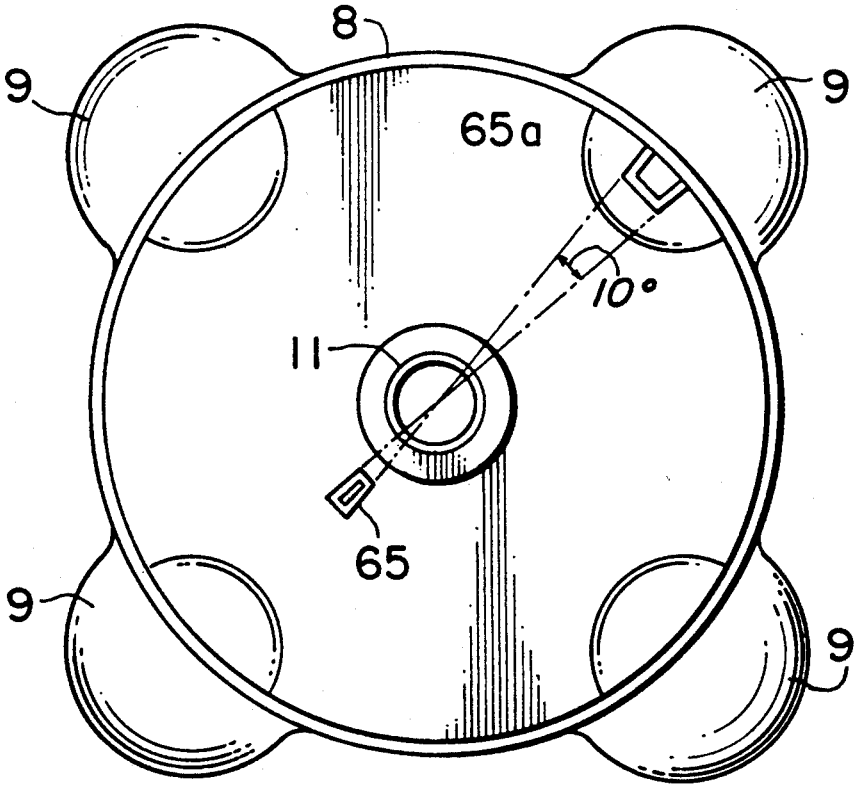
FIG. 13 is an enlarged plan view showing the mount base.

The cover 7 for the opening 6*a* is pivotally supported between the bearing portion of the indicator retainer 29 and the upper case 1*a* to be moved upwardly so as to open the opening 6*a*. A suction port 31 to which an elastic suction hose 30 is to be connected is formed in the cover 7. The suction hose 30 is detachably and rotatably mounted onto the suction port 31 through a curved tubular connector 32. The inlet side of the connector 32 is opened downwardly with a downward slant angle $\theta$ (FIG. 9) of about 9 degrees.

It should be noted that the suction port 31 that is the suction hose mounting portion and the electric blower 2 are disposed diametrically opposite to each other with respect to a turning center of the mount base 8. The suction hose 30 is connected to a curved tube 33, an extension tube 34 and a suction inlet member 35.

A suction port shutter 36, a hose mount port 37, electric connectors 38, a check valve 39 and a packing 40 for a front frame 5*a* of the paper filter 5 are mounted by using a backing plate 41 on the back side of the cover 7. A clamp 42 for the cover 7 is provided at the lower edge portion of the opening 6*a*. A retainer claw 7*a* engageable with the clamp 42 is formed at the lower edge of the cover 7. A rotary rod 43 and springs 44 are provided at the upper edge of the cover 7. The rotary rod 43 is pivotally supported between the indicator retainer 29 and the upper case 1*a* to thereby pivotably mount the cover 7 to the upper case 1*a* so as to open and close the opening 6*a*.

The cover 7 may be moved to a state where the backing plate 41 is held substantially in a vertical position. The cover 7 may be held in the vertical position by the springs 44. An inner case 45 of synthetic resin is provided within the dust collecting portion 6. The inner case 45 serves as a suction air duct from the opening 6*a* to the electric blower 2. An after-filter 46 made of unwoven cloth and sized so as to pass through the opening 6*a*, is provided within the inner case 45. A rotatable holder 47 for holding the front frame 5*a* of the paper filter 5 is provided at an inlet of the after-filter 46. The after-filter 46 may catch relatively small and large size dusts by itself when the paper filter 5 is not used, and the after-filter 46 has enough rigidity to support its shape. An air-tight packing 48 is mounted around the inlet opening edge of the after-filter 46. When the cover 7 closes the opening 6*a*, the air-tight packing 48 comes into pressing contact with the cover 7 and the inlet opening edge 45*a* of the inner case 45 to thereby prevent the suction air flow from leaking out of the inner case 45. The outlet side 45*b* of the inner case 45 is brought into pressing contact with the vibration proof rubber seal member 19 so that the suction air is prevented from leaking from the outlet side 45*b* to the outside of the inner case 45.

Figure 8:
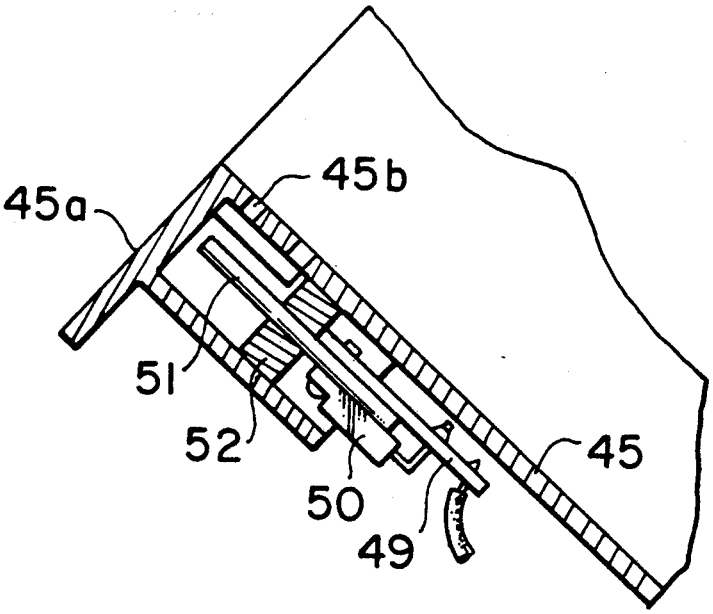
FIG. 8 is an enlarged sectional view showing a part of the control board.

By utilizing a space between the wall of the inner case 45 and the bottom of the lower case 1*b*, an electronic control board 49 on which mounted are electronic parts for controlling the electric blower 2 is mounted in a plane. The electronic control board 49 is fixed to the wall of the inner case 45. An AC phase control FLS element 50 and a metallic cooling fin 51 for cooling the element 50 are mounted on the electronic control board 49. The heat is removed from the metallic cooling fin 51 by the suction air flowing through the inner case 45. A plurality of holes 45*b* are formed in the upper portion of the inner case 45 facing the end portion of the cooling fin 51. An air-tight packing 52 is provided around the metallic cooling fin 51 for preventing the suction air from leaking out of the inner case 45 (FIG. 8).

The cord reel 4 is located near the bottom of the lower case 1*b* and aside the electric blower 2. An inlet/-outlet member 53 is provided at the lower edge portion of the upper case 1*a* for allowing the cord 3 to enter into and be withdrawn from the cleaner body 1. A withdrawal stop lever 54 restricting the withdrawal of the electric source cord 3 and a cord reel button 55 for operating withdrawal stop lever 54 are provided in the vicinity of the cord reel 4. The cord reel button 55 is exposed in a recess 56 formed in the wall of the upper case 1*a*. A connector 57 is provided on the cord reel 4 to electrically connect the cord 3 with the control board 49.

The indicator 28 is in communication at one end thereof with the ambient atmosphere and at the other end thereof with the interior of the inner case 45, thereby moving an indicator hand (not shown) in accordance with negative pressure within the inner case 45. A plurality of ribs 58 are formed around the opening edge portion of the discharge port 23. The discharge port 23 is covered by a metal net 59 of about 50 mesh. A minute dust catching filter 60 of unwoven cloth or the like is provided on the net 59.

An air discharge passage 61 is formed between the mount base 8 and the lower case 1*b* so that the exhaust air from the discharge port to the base mount 8 is discharged from the essentially overall circumference of the peripheral wall of the cleaner body 1 to the outside. The bottom of the lower face 1*b* is kept apart from the mount base 8 to form the discharge path 61 by the circular members 13. An outer diameter of the lower case 1*b* is smaller than an inner diameter of the cylindrical portion of the mount base 8 so that the discharge passage 61 is formed between the outer surface of the lower case and the mount base 8. The exhaust air that has reached the upper opening edge of the mount base 8 through the passage 61 is discharged to the outside through a gap G formed between a lower edge of the case 1*a* and an upper edge of the mount base 8. A flanged portion 62 is formed on the lower edge of the upper case 1*a* to overlap the upper edge of the lower case 1*b* by, so that the exhaust air may flow toward a surface to be cleaned such as a floor. The flanged portion 62 is located outside the upper open edge of the mount base 8 but inside the outer periphery of the bumper 17. The gap G is smaller than an outer diameter of the cord 3.

The wall of the mount base 8 is deformed inwardly to form four recesses, so that the casters 10 do not collide with the mount base 8 when the casters 10 are rotated below the lower surfaces of the legs 9. A concave portion 63 is formed circumferentially over the lower edge of the lower case 1*b*, so that the rotation of the lower case 1*b* is not prevented by the recesses 8*c*. A plurality of projections 64 and 64*a* are formed integrally with the outer surface of the bottom of the lower case 1*b*. A plurality of stops 65 and 65*a*, serving as members for limiting the turning angle of the lower case 1*b*, are formed on the inner surface of the mount base 8.

The projections 64 and 64*a* and the stops 65 and 65*a* are arranged in such relation that, when the lower case 1*b* is turned through about 350 degrees, the projections 64 and 64*a* engage with the stops 65 and 65*a* of the mount base 8.

The engaging shaft 1*c* and the central shaft 11 are brought into contact with each other and the circular members 13 and the mount base 8 are brought into contact with each other, so that the cleaner body 1 is smoothly turned on the mount base 8 in a direction in which the suction hose 30 is drawn, even if the suction hose 30 attached to the cleaner body 1 is drawn in any circumferential direction of the cleaner body 1.

With the foregoing structure, upon starting a cleaning operation, the suction hose 30 is connected to the suction port 31 of the cleaner body 1, the cord 3 is withdrawn from the cord inlet/outlet member 53 and connected to an electric source plug (not shown).

Subsequently, when an operating switch 33*a* provided on the curved tube 33 connected to the suction hose 30 is turned on, the air entraining a large amount of dust will flow from the suction inlet member 31 through the extension tube 34 and the suction hose 30 into the dust collecting portion 6 of the cleaner body 1. Then the dust is filtered through the paper filter 5 provided in the collecting portion 6 so that only the filtered air will flow through the electric blower 2 to be discharged through the discharge port 23, the discharge passage 61 and the gap defined between the mount base 8 and the upper case 1 to the outside of the cleaner body 1.

When the cleaner body 1 is moved by drawing on the suction hose 30, when there is an obstacle such as furniture on the surface to be cleaned, the elastic covers 17*a* and the bumper 17 are, at first, in contact with the obstacle to thereby prevent any damage of the obstacle. In particular, in this embodiment, since the air layer is formed between the bumper 17 and the mount base 8 and is used to absorb the strong impact shock, the damage of the obstacle may be avoided.

Figure 5:
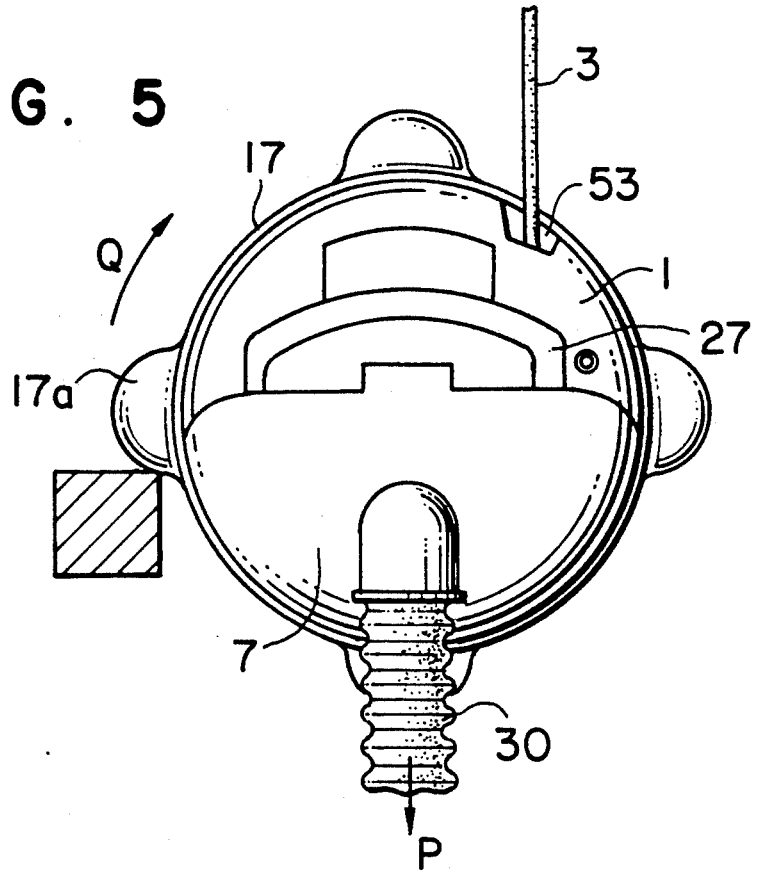
FIGS. 5 and 6 are views illustrative of an escape of the cleaner from an obstacle.
Figure 6:
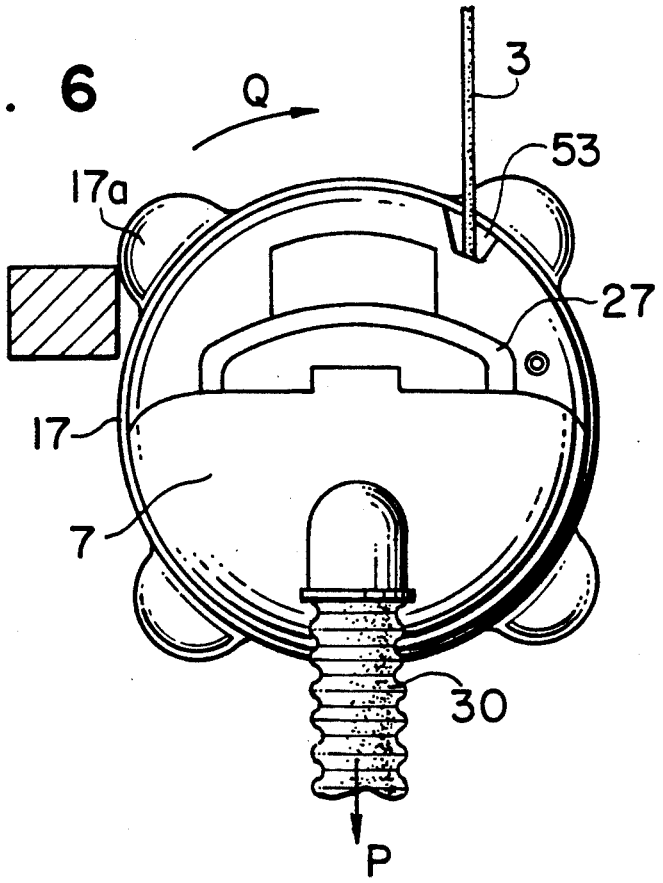
Figure 7:
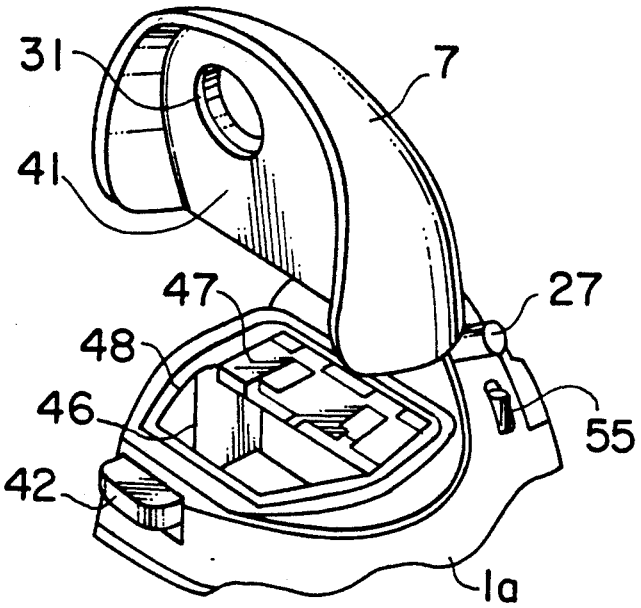
FIG. 7 is a perspective view showing a dust collecting portion.

As shown in FIG. 5, when the suction hose 30 is drawn in a direction P at a time when the bumper 17 and the elastic covers 17*a* are caught by the obstacle, the mount base 8 is turned from the position shown in FIG. 5 to the position shown in FIG. 6 (in a direction Q) so that the mount base 8 is separated from the obstacle. Accordingly, the cleaner 1 may freely travel even in a room where there are lots of obstacles or furniture.

The turning angle of the cleaner body 1 on the mount base 8 is restricted by the projections 64 and 64*a* and the stops 65 and 65*a*. The restriction makes it possible to move the cleaner body 1 without a number of turns of the cord around the mount base 8.

Furthermore, when shag carpet is to be cleaned, even if the mount base 8 is entangled or stopped on the carpet, the suction hose 30 may be drawn clockwise or counterclockwise so that the cleaner body 1 is turned on the mount base 8 to readily change the directions of the cleaner body 1. In addition, the rotational radii of the suction hose 30 and the cleaner body 1 are very short to thereby perform the cleaning work with high efficiency.

Also, since the heavy electric blower 2 and the cord reel 4 are located near the bottom of the lower portion of the cleaner body 1 and are accommodated in the cylindrical portion 8*a* of the mount base 8, the center of gravity of the cleaner body as a whole is more the surface to be cleaned. Additionally, since the legs 9 project radially outwardly from the wall of the mount base 8 and the casters 10 are mounted on the legs 9. Accordingly, there is no fear that the cleaner body 1 would be overturned, and the cleaner body 1 may smoothly travel in the direction in which the suction hose is drawn.

Even if the cleaner body 1 is swung up and down on the mount base 8 during the travel on the surface to be cleaned while the cleaner body is turned, the swing thereof is suppressed by swing limiting ribs 66, 66*a* and 66*b*. Accordingly, the abutments between the projections 64, 64*a* and stops 65, 65*a* will not be released but engage with each other without fail, so that the turning angle of the cleaner body 1 is limited within about 350 degrees. Even if the cleaner body is turned on the mount base to wind the cord around the body, there is no fear that a tension exceeding a predetermined level would be applied to the cord.

Furthermore, in the case where the circular cross-section members 13, i.e., wheels are damaged due to use and it is desired to replace the members 13, the cleaner body 1 is inverted and the coupling member 14 is removed to thereby separate the mount base 8 from the cleaner body 1. When the mount base 8 is separated from the body, the members 13 provided on the outer surface of the bottom of the cleaner body 1 are exposed. Then, the damaged members 13 may readily be replaced.

Furthermore, for assembly of the cleaner body 1 and the mount base 8, the semi-spherical upper case 1*a* is held horizontally by a suitable tool. Subsequently, the inner case 45, the cord reel 4, the sound shielding case 22 and the electric blower 2 are mounted within the upper case 1*a*. Thereafter, the lower case 1*b* to which the members 13 (wheels or rolls) have been premounted is mounted on the upper case 1*a*. Finally, the mount base 8 to which the casters 10 have been premounted is mounted to cover the lower case lb so that the mount base 8 is rotatably mounted on the lower case 1*b*, thereby completing the assembly of the cleaner.

Figure 14:
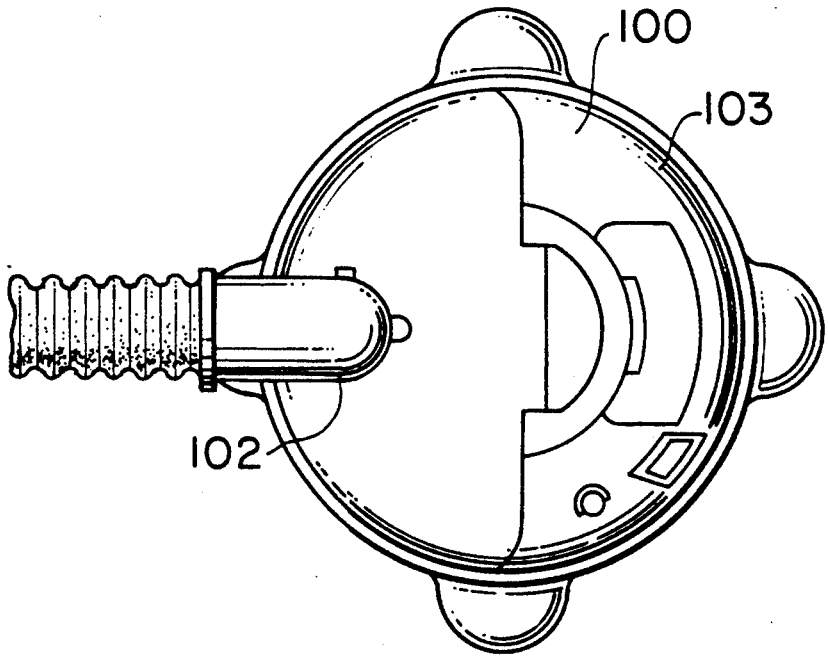
FIG. 14 is a plan view the another embodiment of the invention.

In the foregoing embodiment, specific construction have been described; however any other structures or arrangements may be applied in the same manner. For example, the members 13 may be rotatably mounted on the mount base 8 or may be interposed between the outer surface of the wall of the lower case 1*b* and the inner surface of the wall of the mount base 8. Also, if noise reduction is not a serious concern, as in another embodiment shown in FIG. 14, a suction port 102 onto which a suction hose 101 is mounted and a discharge port 103 for discharging exhaust air of the electric blower from the side of a cleaner body 100 are arranged in the cleaner body 100, so that the exhaust air is discharged in an oblique rearward leftward direction as viewed from the suction port 102. If such arrangement is adapted, it is possible to reduce the amount of the discharge flow to the feet of the user. If, as in the embodiment shown in FIG. 14, the discharge port 103 is formed so as to discharge the air from the side of the cleaner body 100 directly to the outside, the mount base 8 may be perforated in the bottom. The number of the legs 9 and the casters 10 are not limited to four but may be three, or five or more. Also, the number of the circular cross-section members 13 is not limited to three but may be four or more.

Furthermore, if the low center of gravity position feature of the cleaner body 1 may be compromised, the legs 9 may be project outwardly from the bottom of the mount base 8 to the outside of the mount base 8. Further, when the escape characteristics for obstacles are only important and the prevention of an overturning of the cleaner body may be slightly compromised, the legs 9 may be dispensed with and instead thereof, the casters 10 may be mounted on the outer surface of the mount base 8. If the outer diameter of the mount base 8 is required to be extremely larger than that of the cleaner body 1, without providing the legs 9 to the peripheral wall of the mount base 8, the casters 9 may be mounted directly on the outer surface of the mount base 8. In this case, the cleaner body 1 may be prevented from overturning. Further, the construction of the discharge passage 61 defined between the mount base 8 and the cleaner body 1 may be applied to a type of the cleaner body 1 which has a non-semi-spherical upper portion or otherwise to a type of the cleaner body in which the casters 10 are mounted directly on the outer surface of the mount base 8 without providing the legs 9 on the peripheral wall of the mount base 8. The means for limiting the turning angle of the cleaner body 1 may be applied to the type of the cleaner body 1 having a non-semi-spherical upper portion or otherwise to the type of the cleaner body in which the casters 10 are mounted directly on the lower surface of the mount base 8 without providing the legs 9 on the side wall of the mount base 8. Also, this turning angle may exceed 360 degrees. Also, if a short turning radius of the cleaner body 1 may be sacrified, the outer appearance of the cleaner body may be in the form of a parallelepiped box or a cylinder. By virtue of the above-noted features of the present invention, since the moving member at first collides with the obstacle, it is possible to move the cleaner body while escaping away from the obstacle.

Moreover, since the mount base is in the form of a cylinder, it is possible to mount a wide bumper onto the mount base, and then it is possible to move the cleaner body while escaping from the obstacle without damaging the obstacle by the bumper.

Additionally, since the engagement portion between the mount base and the cleaner body has a substantially true circular cross-section, the cleaner body per se may be turned clockwise and counterclockwise at a minimum turning radius, and it is very easy to perform the turn of the cleaner body.

Furthermore, when the suction hose mounted on the cleaner body is drawn clockwise or counterclockwise direction, the legs radially outwardly extending from the mount base serve as as overturning prevention rods to thereby prevent the cleaner body from overturning.

Additionally, since the turning of the cleaner body is limited and the cleaner body is not rotated infinitely in one direction on the mount base, it is possible to prevent the electric cord from being wound around the mount base several times.

Furthermore, the heavy electric blower and the cord reel are mounted on the bottom of the cleaner body to thereby place the center of gravity of the cleaner body near the surface to be cleaned, it is possible to prevent an overturning of the cleaner body.

Also, since the upper portion of the cleaner body is in the form of a hemisphere, it is possible to turn the suction hose at a minimum turning radius in the circumferential direction of the cleaner body together with the cleaner body.

Moreover, since the grip recess for the accessory chamber cover also serves as a grip recess for the handle a round appearance of the cleaner body is unaffected.

With the features of the present invention, it is possible to readily turn the cleaner body with its rotary axis being substantially vertical without any displacement of the cleaner body in respect to the mount base.

Furthermore, even if the suction hose mounted on the semi-spherical portion of the cleaner body is drawn clockwise or counterclockwise direction, the tension force is substantially applied in a direction in which the cleaner body is turned in the circumferential direction. Accordingly, the cleaner body is not overturned but may readily be turned.

Additionally since the cleaner body is formed of the upper case and the lower case, it is possible to easily produce a cleaner in which only the upper portion is semi-spherical.

Furthermore, since the lower case is surrounded by the upper case, even if dust adhering to the upper case is dropped downwardly, the dust will not enter into the interior of the mount base.

Since, according to the present invention the lower surface of each leg is bowl-shaped, it is possible to move the cleaner body over projections on the floor in a smooth fashion. In addition, since the upper surface of the leg is curved, even if the leg collides with an obstacle, the cleaner may smoothly escape from the obstacle and the cord may be prevented from entangling around the leg.

Additionally, since the mount base also serves as a muffler sleeve having a long discharge path to disperse the exhaust gas at a low speed, it is possible to reduce noises generated due to the rotation of the electric blower. In addition, the exhaust air flowing from the bottom of the cleaner body toward the mount base increases a pressure of the discharge passage between the cleaner body and the mount base, so that the cleaner body as a whole is held in a raised condition. Accordingly, it is possible to reduce the rotational torque needed to turn the cleaner body.

Furthermore, it is desired to adapt the structure in which the discharge port is formed in the side of the cleaner body, the exhaust air from the discharge port does not directly impinge against the user during the cleaning work.

Moreover, even with a construction in which the cleaner body is mounted on the mount base, the center of gravity of the overall cleaner may be lowered in the same manner as a cleaner having no mount base so as to enable a stable running of the cleaner body.

By virtue of the low center of gravity, movement of the cleaner body in a desired direction is facilitated.

Additionally, since if is possible to produce the bumper integrally with an elastic cover for each leg of the mounted, the manufacturing process of the cleaner body may be simplified.

Additionally, even if the upper portion of the cleaner body is in the form of a hemisphere, it is possible to readily mount the mount base onto the cleaner body.

We claim:

1. An electrical cleaner comprising:

a cleaner body including an electric blower and a dust collecting portion encasing a filter therein;

a cylindrical mount base for carrying said cleaner body thereon, with a lower portion of said cleaner body being fitted in said cylindrical mount base;

means for enabling a turning and moving of said mount base on a surface to be cleaned;

a suction hose mounted on said cleaner body;

means for supporting said cleaner body in said mount base so as to turnable in a clockwise direction and a counterclockwise direction;

a bumper made of a soft material provided at an outermost peripheral portion of said mount base, and wherein said mount base and said means for supporting said cleaner body are disposed so that an air layer is formed between the outermost peripheral portion of said mount base and said means for supporting said cleaner body in a vicinity of said bumper.

2. An electric cleaner comprising:

a cleaner body including an electric blower and a dust collecting portion encasing a filter therein;

a suction hose mounted on said cleaner body;

a mount base for carrying said cleaner body;

means for enabling a turning of said cleaner body on said mount base in a clockwise or counterclockwise direction of said cleaner body in dependence upon a direction in which a pulling force is applied to said suction hose, means, including said means for enabling the turning, for enabling a moving and turning of said mount base on a surface to be cleaned so as to enable said cleaner body to be movable away from an obstacle on the surface to be cleaned;

means for limiting a turning enable of said cleaner body including a plurality of projections provided on said cleaner body and a plurality of stops provided on said mount base and engagable with said projections; and a plurality of ribs provided between said cleaner body and said mount base for suppressing a swinging movement of said cleaner body;

3. An electric cleaner comprising:

a cleaner body including an electric blower and a dust collecting portion therein;

a mount base for rotatably carrying said cleaner body;

means for enabling a turning and moving of said mount base on a surface to be cleaned;

a cord reel provided in said cleaner body, said cord reel being adapted to accommodate an electrical cord;

a cord port means provided in said cleaner body for enabling said electric cord to be withdrawn from said cleaner body; and a gap provided between said cleaner body and said mount base, said gap having a diameter less than a diameter of said electric cord.

4. The electric cleaner according to claim 3 wherein said cord reel is located in a lower portion of said cleaner body and laterally of said electric blower.

5. An electric cleaner comprising:

a cleaner body including an electric blower and a dust collecting portion encasing a filter therein, said cleaner body including at least an upper part having a semi-spherical configuration;

a suction hose mounted on said cleaner body;

a cylindrical mount base for carrying said cleaner body, said cleaner body including a lower portion fitted in said cylindrical mount base;

means for enabling a turning of said cleaner body on said mount base in a clockwise or counterclockwise direction of said cleaner body in dependence upon a direction in which a pulling force is applied to said suction hose;

means, including said means for enabling the turning, for enabling a moving and turning of said mount base on a surface to be cleaned so as to enable said cleaner body to be movable away from an obstacle on the surface to be cleaned;

a handle pivotally mounted on an upper portion of said cleaner body;

a handle recess means for receiving said handle, said handle recess means being formed in an outer surface of a wall of an upper portion of said cleaner body; and a grip recess for an accessory chamber cover formed contiguously with said handle recess means in said cleaner body.

6. An electrical cleaner comprising:

a cleaner body and a dust collecting portion encasing a filter therein, said cleaner body including at least an upper part having a semi-spherical shape;

a suction hose mounted on said cleaner body;

a mount base for carrying said cleaner body;

means for enabling a turning of said cleaner body on said mount base in a clockwise or counterclockwise direction in dependence upon a direction in which a pulling force is applied to said suction hose;

means, including said means for enabling the turning, for enabling a moving and turning of said mount base on a surface to be cleaned, so as to enable said cleaner body to be movable away from an obstacle on the surface to be cleaned; and a suction port in communication with said collecting portion and spaced from a top of said upper portion, said suction hose being adapted to be mounted through a hose connector to said suction port so that said suction hose is directed in a downward direction toward said surface to be cleaned.

7. An electric cleaner comprising:

a cleaner body including an electric blower and a dust collecting portion encasing a filter therein, said cleaner body including a semi-spherical upper case and a cylindrical lower case;

a suction hose mounted on said cleaner body;

a cylindrical mount base for carrying said cleaner body, said lower case being fitted into said cylindrical mount base;

means for enabling a turning of said cleaner body on said mount base in a clockwise or counterclockwise direction of said cleaner body in dependence upon a direction in which a pulling force is applied to said suction hose; and means, including said means for enabling the turning, for enabling a moving and turning of said mount base on a surface to be cleaned so as to enable said cleaner body to be movable away from an obstacle on the surface to be cleaned.

8. The electric cleaner according to claim 7, wherein an opening in communication with said dust collecting portion is formed in said upper case, a cover is provided for covering said opening, a suction port adapted to accommodate said suction hose is formed on said cover, and said cover is pivotally mounted on an upper portion of said upper case to be movable in said upward direction.

9. The electric cleaner according to claim 7, wherein a plurality of legs are provided on said mount base and extend radially outwardly therefrom, and said meand for enabling a moving and turning are respectively provided on said legs.

10. The electric cleaner according to claim 7, wherein said electric blower and a cord reel for accommodating an electric cord are mounted on a lower portion of an interior of said lower case.

11. An electric cleaner comprising:

a cleaner body including an electric blower and a dust collecting portion encasing a filter therein, said cleaner body including an upper case and a lower case;

a suction hose mounted on said cleaner body;

a cylindrical mount base for carrying said cleaner body, said lower case being fitted into said mount base, and at least an upper peripheral portion of a lower edge of said upper case is one of flush with or inside an outer periphery of an upper edge of said mount base;

means for enabling a turning of said cleaner body on said mount base in a clockwise or counterclockwise direction of said cleaner body in dependence upon a direction in which a pulling force is applied to said suction hose; and means, including said means for enabling the turning, for enabling a moving and turning of said mount base on a surface to be cleaned so as to enable said cleaner body to be moved away from an obstacle on the surface to be cleaned.

12. An electric cleaner comprising:

a cleaner body including a dust collecting portion encasing a filter therein and an electric blower;

a suction hose mounted on said cleaner body;

a mount base for carrying said cleaner body;

means for enabling a turning of said cleaner body on said mount base in a clockwise or counterclockwise direction of said cleaner body in dependence upon a direction in which a pulling force is applied to said suction hose;

a plurality of casters for enabling a moving and turning of said mount base on a surface to be cleaned so as to enable said cleaner body to be moved away from an obstacle on the surface to be cleaned;

a plurality of legs extending outwardly from said mount base, each of said legs including an upper curved surface and respectively accommodating said casters;

a mount frame means for mounting each of said casters, said mount frame means being adapted to cover a lower surface of each of said legs;

a bumper provided on an outer surface of a wall of said mount base; and an elastic cover integrally provided with said bumper for covering each of said legs.

13. An electric cleaner comprising:

a cleaner body including a dust collecting portion encasing a filter therein and an electric blower, said cleaner body including an upper case and a lower case;

a suction hose mounted on said cleaner body;

a cylindrical mount base for carrying said cleaner body, said cleaner body having a lower portion fitted in said cylindrical mount base, said upper case including an outer peripheral surface disposed outside of an outer peripheral surface of an upper edge of said mount base;

means for enabling a turning of said cleaner body on said mount base in a clockwise or counterclockwise direction of said cleaner body in dependence upon a direction in which a pulling force is applied to said suction hose;

means, including said means for enabling the turning, for enabling a moving and turning of said mount base on a surface to be cleaned, so as to enable said cleaner body to be moved away from an obstacle on the surface to be cleaned;

means for discharging exhaust air of said electric blower flowing from an interior of said cleaner body toward said mount base to an exterior of the electric cleaner through a space between said mount base and said cleaner body.

14. The electric cleaner according to claim 13, wherein a flanged portion is formed at a lower edge of said upper case and overlaps an upper edge of said lower case for enabling a discharge of exhaust air in a downward direction.

15. The electric cleaner according to claim 13, further comprising a sound shield case means for covering said electric blower and leading exhaust air of said electric blower to a discharge port formed in a bottom of said cleaner body, and an accessory chamber wall integrally formed with an upper surface of said sound shielding case means.

16. An electric cleaner comprising:

a cleaner body including a dust collecting portion encasing a filter therein and an electric blower;

a suction hose mounted on said cleaner body;

a mount base for carrying said cleaner body;

means for enabling a turning of said cleaner body about a hollow center shaft of said mount base in a clockwise or counterclockwise direction of said claner body in dependence upon a direction in which a pulling force is applied to said suction hose, said means for enabling a turning including an engaging shaft mounted within said center shaft so as to be rotatable in the clockwise and the counterclockwise direction, and a plurality of rotatable members each having a circular cross section disposed between said cleaner body and said mount base to facilitating a turning of said cleaner body;

means, including said means for enabling the turning, for enabling a moving and turning of said mount base on a surface to be cleaned so as to enable said cleaner body to be moved away from an obstacle on the surface to be cleaned;

a recess for communicating with a hollow portion of said center shaft provided in a middle of a bottom of said mount base, said recess exposing a portion of said engaging shaft; and a retainer cover for the engaging shaft fixed to the exposed portion of said engaging shaft by a coupling tool so as to prevent said engaging shaft from dropping out of said mount base.

17. A bumper for an electric cleaner, the bumper comprising an elastic cover integrally formed in one piece comprising a section of the bumper for covering a portion of a wall of a mount base of the electric cleaner, and additional sections of the bumper for covering an upper surface of a plurality of legs supporting said electric cleaner and extending outwardly from said mount base and extending outwardly beyond the horizontal periphery of the wall of the mount base and extending outwardly beyond the horizontal periphery of the wall of the mount base.

18. A method of manufacturing an electric cleaner, the method comprising the steps of:

holding an upper case substantially horizontally with an opening surface of the upper case being directed in an upward direction;

mounting an inner case, a cord reel, a sound shielding case an an electric blower within said upper case;

mounting a cylindrical lower case having premounted wheels onto said upper case; and mounting a mount base having premounted casters onto said lower case.

19. An electric cleaner according to claim 11, wherein a section of a bumper is provided over an entire periphery of a wall of said cylindrical mount base, and wherein an outer peripheral surface of additional sections of said bumper is located radially outside an outer peripheral surface of said upper case.

20. The electric cleaner according to claim 5, wherein an opening in communication with said dust collecting portion is formed in said upper portion of said cleaner body, a cover is provided for covering said opening, and a suction port adapted to accommodate said suction hose is formed in said cover.

21. The electric cleaner according to claim 5, wherein a plurality of legs are provided on said mount base and extend radially outwardly therefrom, and wherein said means for enabling a moving and turning is provided on the respective legs.

22. The electric cleaner according to claim 21 wherein said electric blower and a cord reel for accommodating an electric cord are mounted on a lower portion of said mount base.

23. A bumper for an electric cleaner according to claim 17, wherein an air layer is formed between the bumper and said mount base.

24. A bumper according to claim 17, wherein said mount base includes a rib having a T-shaped cross-sectional configuration, and having said bumper includes opposed edge portions inserted between said rib and said mount base.

* * * * *